US007291063B2

(12) United States Patent
Swisher et al.

(10) Patent No.: US 7,291,063 B2
(45) Date of Patent: Nov. 6, 2007

(54) POLYURETHANE UREA POLISHING PAD

(75) Inventors: Robert G. Swisher, Pittsburgh, PA (US); Alan E. Wang, Gibsonia, PA (US); William C. Allison, Murrysville, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 11/489,331

(22) Filed: Jul. 19, 2006

(65) Prior Publication Data

US 2006/0254706 A1 Nov. 16, 2006

Related U.S. Application Data

(62) Division of application No. 10/974,528, filed on Oct. 27, 2004, now abandoned.

(51) Int. Cl.
*B24D 11/00* (2006.01)

(52) U.S. Cl. ..... 451/533; 451/56

(58) Field of Classification Search ..... 451/28, 451/41, 54, 56, 526–539; 438/691–693
See application file for complete search history.

(56) References Cited

U.S. PATENT DOCUMENTS

| | | | |
|---|---|---|---|
| 1,110,331 | A | 9/1914 | McLean |
| 2,644,007 | A | 6/1953 | Irwin et al. |
| 2,680,127 | A | 6/1954 | Slocombe et al. |
| 2,786,042 | A | 3/1957 | Ilar |
| 3,334,062 | A | 8/1967 | Brown et al. |
| 3,634,288 | A | 1/1972 | Youngs |
| 3,720,532 | A | 3/1973 | Simpson et al. |
| 3,763,054 | A | 10/1973 | Reischl et al. |
| 3,768,537 | A | 10/1973 | Hese et al. |
| 4,015,031 | A | 3/1977 | Reingardt et al. |
| 4,068,024 | A | 1/1978 | Laufer |
| 4,143,027 | A | 3/1979 | Sollman et al. |
| 4,160,853 | A | 7/1979 | Ammons |
| 4,443,357 | A | 4/1984 | Maloney et al. |
| 4,554,147 | A | 11/1985 | Stoll |
| 4,664,679 | A | 5/1987 | Kohyama et al. |
| 4,728,552 | A | 3/1988 | Jensen, Jr. |
| 4,849,022 | A | 7/1989 | Kobayashi et al. |
| 4,880,843 | A | 11/1989 | Stein |
| 4,997,684 | A | 3/1991 | Franz et al. |
| 5,008,305 | A | 4/1991 | Kennan et al. |
| 5,041,467 | A | 8/1991 | Kataoka et al. |
| 5,155,165 | A | 10/1992 | Maruyama et al. |
| 5,257,478 | A | 11/1993 | Hyde et al. |
| 5,292,829 | A | 3/1994 | Konno et al. |
| 5,328,768 | A | 7/1994 | Goodwin |
| 5,353,999 | A | 10/1994 | Dew et al. |
| 5,403,228 | A | 4/1995 | Pasch |
| 5,484,581 | A | 1/1996 | Esch et al. |
| 5,523,161 | A | 6/1996 | Goodwin |
| 5,523,162 | A | 6/1996 | Franz et al. |
| 5,571,373 | A | 11/1996 | Krishna et al. |
| 5,571,623 | A | 11/1996 | Kuriyama et al. |
| 5,578,362 | A | 11/1996 | Reinhardt et al. |
| 5,631,339 | A | 5/1997 | Faler et al. |
| 5,647,962 | A | 7/1997 | Jansen et al. |
| 5,691,392 | A | 11/1997 | Okoroafor et al. |
| 5,693,738 | A | 12/1997 | Okazaki et al. |
| 5,705,137 | A | 1/1998 | Goerl et al. |
| 5,720,551 | A | 2/1998 | Shechter |
| 5,739,197 | A | 4/1998 | Swift et al. |
| 5,767,016 | A | 6/1998 | Muroyama |
| 5,789,514 | A | 8/1998 | Burns et al. |
| 5,846,506 | A | 12/1998 | Esch et al. |
| 5,885,334 | A | 3/1999 | Suzuki et al. |
| 5,888,467 | A | 3/1999 | Swift et al. |
| 5,893,796 | A | 4/1999 | Birang |
| 5,900,164 | A | 5/1999 | Budinger et al. |
| 5,902,635 | A | 5/1999 | Garafalo et al. |
| 5,902,636 | A | 5/1999 | Grabbe et al. |
| 5,904,159 | A | 5/1999 | Kato et al. |
| 5,908,660 | A | 6/1999 | Griffith et al. |
| 5,911,963 | A | 6/1999 | Krivak et al. |
| 5,919,298 | A | 7/1999 | Griffith et al. |
| 5,922,298 | A | 7/1999 | Boyer et al. |
| 5,954,975 | A | 9/1999 | Cadien et al. |
| 5,964,643 | A | 10/1999 | Birang et al. |
| 5,976,000 | A | 11/1999 | Hudson |
| 5,980,775 | A | 11/1999 | Grumbine et al. |

(Continued)

FOREIGN PATENT DOCUMENTS

EP 1 108 501 B1 3/1996

(Continued)

OTHER PUBLICATIONS

D.M. Young, F. Hostettler et al., "Polyesters from Lactone," Union Carbide F-40, p. 147.

(Continued)

*Primary Examiner*—Dung Van Nguyen
(74) *Attorney, Agent, or Firm*—Deborah M. Altman; Frank P. Mallak

(57) ABSTRACT

The present invention relates to an article for altering a surface of a workpiece, or a polishing pad having a window. In particular, the polishing pad includes a polyurethane urea material wherein the polyurethane urea material contains cells which are at least partially filled with gas. The polyurethane urea material can be prepared by combining polyisocyanate and/or polyurethane prepolymer, hydroxyl-containing material, amine-containing material and blowing agent. The polishing pad according to the present invention is useful for polishing articles, and is especially useful for chemical mechanical polishing or planarization of microelectronic and optical electronic devices such as but not limited to semiconductor wafers. The window of the polishing pad is at least partially transparent and thus, can be particularly useful with polishing or planarizing tools that are equipped with through-the-platen wafer metrology.

14 Claims, No Drawings

U.S. PATENT DOCUMENTS 5,985,748 A 11/1999 Watts et al.
6,017,265 A 1/2000 Cook et al.
6,022,268 A 2/2000 Roberts et al.
6,046,099 A 4/2000 Cadien et al.
6,059,944 A 5/2000 Dubois et al.
6,062,968 A 5/2000 Sevilla et al.
6,063,306 A 5/2000 Kaufman et al.
6,068,539 A 5/2000 Bajaj et al.
6,069,080 A 5/2000 James et al.
6,077,153 A 6/2000 Fujita et al.
6,083,840 A 7/2000 Mravic et al.
6,086,669 A 7/2000 Patkar et al.
6,099,954 A 8/2000 Urbanavage et al.
6,106,754 A 8/2000 Cook et al.
6,107,265 A 8/2000 Clarkson et al.
6,117,000 A 9/2000 Anjur et al.
6,120,353 A 9/2000 Suzuki et al.
6,123,609 A 9/2000 Satou
6,126,532 A 10/2000 Sevilla et al.
6,136,711 A 10/2000 Grumbine et al.
6,159,073 A 12/2000 Wiswesser et al.
6,171,181 B1 1/2001 Roberts et al.
6,183,872 B1 2/2001 Tanaka et al.
6,187,444 B1 2/2001 Bowles, III et al.
6,213,845 B1 4/2001 Elledge
6,217,416 B1 4/2001 Kaufman et al.
6,231,434 B1 5/2001 Cook et al.
6,248,144 B1 6/2001 Tamai et al.
6,254,459 B1 7/2001 Bajaj et al.
6,294,470 B1 9/2001 Economikos et al.
6,315,803 B1 11/2001 Ina et al.
6,325,703 B2 12/2001 Cook et al.
6,337,281 B1 1/2002 James et al.
6,368,955 B1 4/2002 Easter et al.
6,375,545 B1 4/2002 Yano et al.
6,387,312 B1 5/2002 Roberts et al.
6,402,591 B1 6/2002 Thornton
6,409,781 B1 6/2002 Wojtczak et al.
6,419,556 B1 7/2002 Urbanavage et al.
6,432,825 B1 8/2002 Torii
6,439,968 B1 8/2002 Obeng
6,439,989 B1 8/2002 Reinhardt et al.
6,443,610 B1 9/2002 Shechter et al.
6,447,371 B2 9/2002 Brusic Kaufman et al.
6,451,697 B1 9/2002 Sun et al.
6,454,819 B1 9/2002 Yano et al.
6,458,014 B1 10/2002 Ishikawa et al.
6,464,576 B1 10/2002 Freeman et al.
6,477,926 B1 11/2002 Swisher et al.
6,485,355 B1 11/2002 Economikos et al.
6,503,418 B2 1/2003 Sahota et al.
6,524,164 B1 2/2003 Tolles
6,555,466 B1 4/2003 Laursen et al.
6,579,153 B2 6/2003 Uchikura et al.
6,588,769 B2 7/2003 Burdock
6,620,036 B2 9/2003 Freeman et al.
6,656,241 B1 12/2003 Hellring et al.
6,659,846 B2 12/2003 Misra et al.
6,685,537 B1 2/2004 Fruitman
6,716,085 B2 4/2004 Wiswesser
6,720,264 B2 4/2004 Sahota et al.
6,749,329 B2 6/2004 Shechter et al.
6,776,810 B1 8/2004 Cherian et al.
6,790,883 B2 9/2004 Ogawa et al.
6,800,218 B2 10/2004 Ma et al.
6,811,474 B2 11/2004 Cherian et al.
6,824,579 B2 11/2004 Ronay
6,832,947 B2 12/2004 Manning
6,832,949 B2 * 12/2004 Konno et al. ..... 451/285
6,832,950 B2 12/2004 Wright
6,837,781 B2 * 1/2005 Hishiki ..... 451/527
6,841,480 B2 1/2005 Simpson et al.
6,875,077 B2 4/2005 Petroski
6,878,039 B2 4/2005 Yang
6,884,156 B2 * 4/2005 Prasad et al. ..... 451/533
6,896,585 B2 5/2005 Tolles
6,905,402 B2 6/2005 Allison et al.
6,908,366 B2 6/2005 Gagliardi
6,910,944 B2 6/2005 Birang et al.
6,932,672 B2 8/2005 Elledge
6,945,846 B1 9/2005 Petroski
6,960,120 B2 11/2005 Prasad
6,964,923 B1 11/2005 Ronay
6,981,144 B2 12/2005 Bauman et al.
6,984,163 B2 1/2006 Roberts
6,994,607 B2 2/2006 Wiswesser
7,011,565 B2 3/2006 Birang
7,011,574 B2 3/2006 Simpson
7,018,581 B2 3/2006 David
7,097,549 B2 8/2006 Allison et al.
7,118,450 B2 10/2006 Birang
2001/0024940 A1 9/2001 Cook et al.
2002/0010232 A1 1/2002 Ogawa et al.
2002/0106900 A1 8/2002 Vogt et al.
2002/0155795 A1 10/2002 Ferra et al.
2003/0094593 A1 5/2003 Hellring et al.
2003/0109209 A1 6/2003 Hishiki
2003/0171070 A1 9/2003 Tolles
2003/0171081 A1 9/2003 Takuji et al.
2003/0217517 A1 11/2003 Allison et al.
2003/0228836 A1 12/2003 Lombardo
2004/0018809 A1 * 1/2004 Petroski et al. ..... 451/537
2004/0021243 A1 2/2004 Shih
2004/0067649 A1 4/2004 Hellring
2004/0082271 A1 4/2004 Wiswesser
2004/0089813 A1 5/2004 Takabayashi et al.
2004/0094855 A1 5/2004 Shih
2004/0102137 A1 5/2004 Allison et al.
2004/0102141 A1 5/2004 Swisher
2004/0209066 A1 10/2004 Swisher et al.
2004/0224611 A1 11/2004 Aoi et al.
2004/0259484 A1 12/2004 Prasad et al.
2005/0060943 A1 * 3/2005 Turner et al. ..... 51/297
2005/0064802 A1 3/2005 Oshana
2005/0090187 A1 4/2005 Shih
2005/0266771 A1 12/2005 Wiswesser
2006/0183412 A1 8/2006 Allison

FOREIGN PATENT DOCUMENTS

EP 1164559 A1 12/2001
WO WO9615887 5/1996
WO WO9845087 10/1998
WO WO9847662 10/1998
WO WO9907515 8/1999
WO WO9964527 12/1999
WO WO0104226 A2 1/2001
WO WO0112730 A1 2/2001
WO WO0144402 A1 6/2001
WO WO0222701 A2 3/2002
WO WO 2004/028744 A1 4/2004

OTHER PUBLICATIONS

Ullmann's Encyclopedia of Industrial Chemistry, 5th Edition, 1992, vol. A21, pp. 673-674.
ASTM Designation: D 1622-88 "Standard Test Method for Apparent Density of Rigid Cellular Plastics[1]".
ASTM Designation: D 4284-88 "Standard Test Method for Determining Pore Volume Distribution of Catalysts by Mercury Intrusion Porosimetry[1]".
ASTM Designation: D 2240-03 "Standard Test Method for Rubber Property—Durometer Hardness[1]".

* cited by examiner

POLYURETHANE UREA POLISHING PAD

This application is a division of U.S. patent application Ser. No. 10/974,528 filed Oct. 27, 2004 now abandoned.

The present invention relates to an article for altering a surface of a workpiece. In particular, the present invention is directed to a polishing pad having a window. More particularly, the polishing pad can include a polyurethane urea material wherein cells at least partially filled with gas are substantially uniformly distributed throughout the material and/or pad. The polyurethane urea material can be prepared by combining polyisocyanate and/or polyurethane prepolymer; hydroxyl-containing material; amine-containing material and blowing agent. The polishing pad according to the present invention is useful for polishing articles, and is especially useful for chemical mechanical polishing or planarization of microelectronic and optical electronic devices such as but not limited to semiconductor wafers. The window of the polishing pad is at least partially transparent and thus, can be particularly useful with polishing or planarizing tools that are equipped with through-the-platen wafer metrology.

The polishing or planarization of a rough surface of an article such as a microelectronic device, to a substantially smooth surface generally involves rubbing the rough surface with the work surface of a polishing pad using a controlled and repetitive motion. A polishing fluid can be interposed between the rough surface of the article that is to be polished and the work surface of the polishing pad.

The fabrication of a microelectronic device can comprise the formation of a plurality of integrated circuits on a semiconductor substrate. The composition of the substrate can include silicon or gallium arsenide. The integrated circuits generally can be formed by a series of process steps in which patterned layers of materials, such as conductive, insulating and semi-conducting materials, are formed on the substrate. In order to maximize the density of integrated circuits per wafer, it is desirable to have a planar polished substrate at various stages throughout the production process. As such, production of a microelectronic device typically involves at least one polishing step and can often involve a plurality of polishing steps, which can result in the use of more than one polishing pad.

The polishing step can include rotating the polishing pad and the semiconductor substrate against each other in the presence of a polishing fluid. The polishing fluid can be mildly alkaline and can optionally contain an abrasive particulate material such as but not limited to particulate cerium oxide, particulate alumina, or particulate silica. The polishing fluid can facilitate the removal and transport of abraded material off and away from the rough surface of the article.

Polishing pad characteristics such as pore volume and pore size can vary from pad-to-pad and throughout the operating lifetime of a particular pad. Variations in the polishing characteristics of the pads can result in inadequately polished and planarized substrates which can be unsuitable for fabricating semiconductor wafers. Thus, it is desirable to develop a polishing pad that exhibits reduced pad-to-pad variation in polishing and planarization characteristics. It is further desirable to develop a polishing pad that exhibits reduced variations in polishing and planarization characteristics throughout the operating lifetime of the pad.

Planarizing tools having the ability to measure the progress of the planarization process while the wafer is held in the tool and in contact with the pad are known in the art.

Measuring the progress of planarizing a microelectronic device during the planarizing process can be referred to in the art as "in-situ metrology". U.S. Pat. Nos. 5,964,643 and 6,159,073; and European Patent 1,108,501 describe polishing or planarizing tools and in-situ metrology systems. In general, in-situ metrology can include directing a beam of light through an at least partially transparent window located in the platen of the tool; the beam of light can be reflected off the surface of the wafer, back through the platen window, and into a detector. The polishing pad can include a window that is at least partially transparent to the wavelengths used in the metrology system, and essentially aligned with the planten window.

Thus, it is desirable to develop a polishing pad that comprises a window area useful for in-situ metrology. It is further desirable that the window provides suitable transparency throughout the operating life of the pad.

One disadvantage with known pads having windows which are coplanar with the polishing surface, can include wearing of the window portion at a slower rate than the pad surface. A further disadvantage with known pads having a coplanar window can include scratching of the window as a result of its contact with abrasive particles in the slurry during the polishing or planarization process. A scratched window can generally reduce the transparency of the window and can cause an attenuation of the metrology signal.

For the purposes of this specification, unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

The present invention includes a pad having an at least partially transparent cast-in-place window adapted to polish a microelectronic substrate. The pad of the present invention comprises polyurethane urea material. At least a portion of the polyurethane urea contains cells that are at least partially filled with gas, and at least a portion of the at least partially gas-filled cells is formed by an in-situ reaction.

In a non-limiting embodiment, the cells can be substantially uniformly distributed throughout the material and/or pad. In another non-limiting embodiment, the polyurethane urea can be prepared by combining polyisocyanate, hydroxyl-containing material, amine-containing material and blowing agent. In another non-limiting embodiment, the polyurethane urea can be formed by condensation polymerization of polyisocyanate functional polyurethane prepolymer with polyamine and blowing agent. In a further non-limiting embodiment, the polyurethane urea can be formed by combining polyisocyanate and polyurethane prepolymer, optional hydroxyl-containing material, amine-containing material and blowing agent. In a non-limiting embodiment, at least a portion of the pad can comprise a window which is at least partially transparent to wavelengths used by the metrology instrumentation of polishing tools.

In alternate non-limiting embodiments, the amount of polyisocyanate, hydroxyl-containing material and amine-containing material can be selected such that the equivalent ratio of (NCO+NCS):(NH+OH) can be greater than 0.95, or at least 1.0, or at least 1.05, or less than 1.3, or less than 1.2, or less than 1.1.

Polyisocyanates useful in the preparation of the polyurethane urea of the present invention are numerous and widely varied. Suitable polyisocyanates can include but are not limited to polymeric and $C_2$—$C_{20}$ linear, branched, cyclic and aromatic polyisocyanates. Non-limiting examples can include polyisocyanates having backbone linkages chosen from urethane linkages (—NH—C(O)—O—).

The molecular weight of the polyisocyanate can vary widely. In alternate non-limiting embodiments, the number average molecular weight (Mn) can be at least 100 grams/mole, or at least 150 grams/mole, or less than 15,000 grams/mole, or less than 5000 grams/mole. The number average molecular weight can be determined using known methods. The number average molecular weight values recited herein and the claims were determined by gel permeation chromatography (GPC) using polystyrene standards.

Non-limiting examples of suitable polyisocyanates can include but are not limited to polyisocyanates having at least two isocyanate groups.

Non-limiting examples of polyisocyanates can include but are not limited to aliphatic polyisocyanates, cycloaliphatic polyisocyanates wherein one or more of the isocyanato groups are attached directly to the cycloaliphatic ring, cycloaliphatic polyisocyanates wherein one or more of the isocyanato groups are not attached directly to the cycloaliphatic ring, aromatic polyisocyanates wherein one or more of the isocyanato groups are attached directly to the aromatic ring, and aromatic polyisocyanates wherein one or more of the isocyanato groups are not attached directly to the aromatic ring.

In a non-limiting embodiment of the present invention, the polyisocyanate can include but is not limited to aliphatic or cycloaliphatic diisocyanates, aromatic diisocyanates, cyclic dimers and cyclic trimers thereof, and mixtures thereof. Non-limiting examples of suitable polyisocyanates can include but are not limited to Desmodur N 3300A (hexamethylene diisocyanate trimer) which is commercially available from Bayer; Desmodur N 3400 (60% hexamethylene diisocyanate dimer and 40% hexamethylene diisocyanate trimer).

In a non-limiting embodiment, the polyisocyanate can include dicyclohexylmethane diisocyanate and isomeric mixtures thereof. As used herein and the claims, the term "isomeric mixtures" refers to a mixture of the cis-cis, trans-trans, and cis-trans isomers of the polyisocyanate. Non-limiting examples of isomeric mixtures for use in the present invention can include the trans-trans isomer of 4,4'-methylenebis(cyclohexyl isocyanate), hereinafter referred to as "PICM" (paraisocyanato cyclohexylmethane), the cis-trans isomer of PICM, the cis-cis isomer of PICM, and mixtures thereof.

In one non-limiting embodiment, the PICM used in this invention can be prepared by phosgenating the 4,4'-methylenebis(cyclohexyl amine) (PACM) by procedures well known in the art such as the procedures disclosed in U.S. Pat. Nos. 2,644,007 and 2,680,127 which are incorporated herein by reference. The PACM isomer mixtures, upon phosgenation, can produce PICM in a liquid phase, a partially liquid phase, or a solid phase at room temperature. The PACM isomer mixtures can be obtained by the hydrogenation of methylenedianiline and/or by fractional crystallization of PACM isomer mixtures in the presence of water and alcohols such as methanol and ethanol.

In a non-limiting embodiment, the isomeric mixture can contain from 10-100 percent of the trans,trans isomer of 4,4'-methylenebis(cyclohexyl isocyanate) (PICM).

In a non-limiting embodiment, the polyisocyanate can include 2,4-tolylene diisocyanate; 2,6-tolylene diisocyanate and mixtures of these isomers ("TDI").

Additional aliphatic and cycloaliphatic diisocyanates that can be used in alternate non-limiting embodiments of the present invention include 3-isocyanato-methyl-3,5,5-trimethyl cyclohexyl-isocyanate ("IPDI") which is commercially available from Arco Chemical, and meta-tetramethylxylene diisocyanate (1,3-bis(1-isocyanato-1-methylethyl)-benzene) which is commercially available from Cytec Industries Inc. under the tradename TMXDI.RTM. (Meta) Aliphatic Isocyanate.

As used herein and the claims, the terms aliphatic and cycloaliphatic diisocyanates refer to 6 to 100 carbon atoms linked in a straight chain or cyclized having two diisocyanate reactive end groups. In a non-limiting embodiment of the present invention, the aliphatic and cycloaliphatic diisocyanates for use in the present invention can include TMXDI and compounds of the formula R—$(NCO)_2$ wherein R represents an aliphatic group or a cycloaliphatic group.

Further non-limiting examples of suitable polyisocyanates can include but are not limited to aliphatic polyisocyanates; ethylenically unsaturated polyisocyanates; alicyclic polyisocyanates; aromatic polyisocyanates wherein the isocyanate groups are not bonded directly to the aromatic ring, e.g., $\alpha,\alpha'$-xylene diisocyanate; aromatic polyisocyanates wherein the isocyanate groups are bonded directly to the aromatic ring, e.g., benzene diisocyanate; halogenated, alkylated, alkoxylated, nitrated, carbodiimide-modified, urea-modified and biuret-modified derivatives of polyisocyanates thereof; and dimerized and trimerized products of polyisocyanates thereof.

Further non-limiting examples of aliphatic polyisocyanates can include ethylene diisocyanate, trimethylene diisocyanate, tetramethylene diisocyanate, hexamethylene diisocyanate, octamethylene diisocyanate, nonamethylene diisocyanate, 2,2'-dimethylpentane diisocyanate, 2,2,4-trimethylhexane diisocyanate, decamethylene diisocyanate, 2,4,4,-trimethylhexamethylene diisocyanate, 1,6,11-undecanetriisocyanate, 1,3,6-hexamethylene triisocyanate, 1,8-diisocyanato-4-(isocyanatomethyl)octane, 2,5,7-trimethyl-1,8-diisocyanato-5-(isocyanatomethyl)octane, bis(isocyanatoethyl)-carbonate, bis(isocyanatoethyl)ether, 2-isocyanatopropyl-2,6-diisocyanatohexanoate, lysinediisocyanate methyl ester and lysinetriisocyanate methyl ester.

Examples of ethylenically unsaturated polyisocyanates can include but are not limited to butene diisocyanate and 1,3-butadiene-1,4-diisocyanate. Alicyclic polyisocyanates can include but are not limited to isophorone diisocyanate, cyclohexane diisocyanate, methylcyclohexane diisocyanate, bis(isocyanatomethyl) cyclohexane, bis(isocyanatocyclohexyl)methane, bis(isocyanatocyclohexyl)-2,2-propane, bis(isocyanatocyclohexyl)-1,2-ethane, 2-isocyanatomethyl-3-(3-isocyanatopropyl)-5-isocyanatomethyl-bicyclo[2.2.1]-heptane, 2-isocyanatomethyl-3-(3-isocyanatopropyl)-6-isocyanatomethyl-bicyclo[2.2.1]-heptane, 2-isocyanatomethyl-2-(3-isocyanatopropyl)-5-isocyanatomethyl-bicyclo[2.2.1]-heptane, 2-isocyanatomethyl-2-(3-isocyanatopropyl)-6-isocyanatomethyl-bicyclo[2.2.1]-heptane, 2-isocyanatomethyl-3-(3-isocyanatopropyl)-6-(2-isocyanatoethyl)-bicyclo[2.2.1]-heptane, 2-isocyanatomethyl-2-(3-isocyanatopropyl)-5-(2-isocyanatoethyl)-bicyclo[2.2.1]-heptane and 2-isocyanatomethyl-2-(3-isocyanatopropyl)-6-(2-isocyanatoethyl)-bicyclo[2.2.1]-heptane.

Examples of aromatic polyisocyanates wherein the isocyanate groups are not bonded directly to the aromatic ring can include but are not limited to bis(isocyanatoethyl) benzene, α,α,α',α'-tetramethylxylene diisocyanate, 1,3-bis (1-isocyanato-1-methylethyl)benzene, bis(isocyanatobutyl) benzene, bis(isocyanatomethyl)naphthalene, bis (isocyanatomethyl)diphenyl ether, bis(isocyanatoethyl) phthalate, mesitylene triisocyanate and 2,5-di (isocyanatomethyl)furan. Aromatic polyisocyanates having isocyanate groups bonded directly to the aromatic ring can include but are not limited to phenylene diisocyanate, ethylphenylene diisocyanate, isopropylphenylene diisocyanate, dimethylphenylene diisocyanate, diethylphenylene diisocyanate, diisopropylphenylene diisocyanate, trimethylbenzene triisocyanate, benzene triisocyanate, naphthalene diisocyanate, methylnaphthalene diisocyanate, biphenyl diisocyanate, ortho-toluidine diisocyanate, ortho-tolylidine diisocyanate, ortho-tolylene diisocyanate, 4,4'-diphenylmethane diisocyanate, bis(3-methyl-4-isocyanatophenyl)methane, bis(isocyanatophenyl)ethylene, 3,3'-dimethoxy-biphenyl-4,4'-diisocyanate, triphenylmethane triisocyanate, polymeric 4,4'-diphenylmethane diisocyanate, naphthalene triisocyanate, diphenylmethane-2,4,4'-triisocyanate, 4-methyldiphenylmethane-3,5,2',4',6'-pentaisocyanate, diphenylether diisocyanate, bis(isocyanatophenylether)ethyleneglycol, bis(isocyanatophenylether)-1,3-propyleneglycol, benzophenone diisocyanate, carbazole diisocyanate, ethylcarbazole diisocyanate and dichlorocarbazole diisocyanate.

In alternate non-limiting embodiments of the present invention, polyisothiocyanate or a combination of polyisocyanate and polyisothiocyanate can be used in place of polyisocyanate. In these alternate non-limiting embodiments, isothiocyanate can have at least two isothiocyanate groups.

In a non-limiting embodiment of the present invention, the polyisocyanate for use in the present invention can include polyurethane prepolymer.

In a non-limiting embodiment, polyisocyanate can be reacted with hydroxyl-containing material to form polyurethane prepolymer. Hydroxyl-containing materials are varied and known in the art. Non-limiting examples can include but are not limited to polyols; sulfur-containing materials such as but not limited to hydroxyl functional polysulfides, and SH—containing materials such as but not limited to polythiols; and materials having both hydroxyl and thiol functional groups.

Suitable hydroxyl-containing materials for use in the present invention can include a wide variety of materials known in the art. Non-limiting examples can include but are not limited to polyether polyols, polyester polyols, polycaprolactone polyols, polycarbonate polyols, and mixtures thereof.

Polyether polyols and methods for their preparation are known to one skilled in the art. Many polyether polyols of various types and molecular weight are commercially available from various manufacturers. Non-limiting examples of polyether polyols can include but are not limited to polyoxyalkylene polyols, and polyalkoxylated polyols. Polyoxyalkylene polyols can be prepared in accordance with known methods. In a non-limiting embodiment, a polyoxyalkylene polyol can be prepared by condensing an alkylene oxide, or a mixture of alkylene oxides, using acid-or base-catalyzed addition with a polyhydric initiator or a mixture of polyhydric initiators, such as but not limited to ethylene glycol, propylene glycol, glycerol, and sorbitol. Non-limiting examples of alkylene oxides can include ethylene oxide, propylene oxide, butylene oxide, amylene oxide, aralkylene oxides, such as but not limited to styrene oxide, mixtures of ethylene oxide and propylene oxide. In a further non-limiting embodiment, polyoxyalkylene polyols can be prepared with mixtures of alkylene oxide using random or step-wise oxyalkylation. Non-limiting examples of such polyoxyalkylene polyols include polyoxyethylene, such as but not limited to polyethylene glycol, polyoxypropylene, such as but not limited to polypropylene glycol.

In a non-limiting embodiment, polyalkoxylated polyols can be represent by the following general formula:

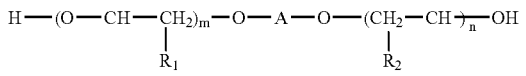

(I)

wherein m and n can each be a positive integer, the sum of m and n being from 5 to 70; $R_1$ and $R_2$ are each hydrogen, methyl or ethyl; and A is a divalent linking group such as a straight or branched chain alkylene which can contain from 1 to 8 carbon atoms, phenylene, and $C_1$ to $C_9$ alkyl-substituted phenylene. The chosen values of m and n can, in combination with the chosen divalent linking group, determine the molecular weight of the polyol.

Polyalkoxylated polyols can be prepared by methods that are known in the art. In a non-limiting embodiment, a polyol such as 4,4'-isopropylidenediphenol can be reacted with an oxirane-containing material such as but not limited to ethylene oxide, propylene oxide and butylene oxide, to form what is commonly referred to as an ethoxylated, propoxylated or butoxylated polyol having hydroxy functionality. Non-limiting examples of polyols suitable for use in preparing polyalkoxylate polyols can include those polyols described in U.S. Pat. No. 6,187,444 B1 at column 10, lines 1-20, which disclosure is incorporated herein by reference.

As used herein and the claims, the term "polyether polyols" can include the generally known poly(oxytetramethylene) diols prepared by the polymerization of tetrahydrofuran in the presence of Lewis acid catalysts such as but not limited to boron trifluoride, tin (IV) chloride and sulfonyl chloride. In a non-limiting embodiment, the polyether polyol can include Terathane™ which is commercially available from DuPont. Also included are the polyethers prepared by the copolymerization of cyclic ethers such as but not limited to ethylene oxide, propylene oxide, trimethylene oxide, and tetrahydrofuran with aliphatic diols such as but not limited to ethylene glycol, 1,3-butanediol, 1,4-butanediol, diethylene glycol, dipropylene glycol, 1,2-propylene glycol and 1,3-propylene glycol. Compatible mixtures of polyether polyols can also be used. As used herein, "compatible" means that the polyols are mutually soluble in each other so as to form a single phase.

A wide variety of polyester polyols known in the art can be used in the present invention. Suitable polyester polyols can include but are not limited to polyester glycols. Polyester glycols for use in the present invention can include the esterification products of one or more dicarboxylic acids having from four to ten carbon atoms, such as but not limited to adipic, succinic or sebacic acids, with one or more low molecular weight glycols having from two to ten carbon atoms, such as but not limited to ethylene glycol, propylene glycol, diethylene glycol, 1,4-butanediol, neopentyl glycol, 1,6-hexanediol and 1,10-decanediol. Esterification procedures for producing polyester polyols is described, for example, in the article D. M. Young, F. Hostettler et al., "Polyesters from Lactone," Union Carbide F-40, p. 147.

In a non-limiting embodiment, the polyol for use in the present invention can include polycaprolactone polyols. Suitable polycaprolactone polyols are varied and known in the art. In a non-limiting embodiment, polycaprolactone polyols can be prepared by condensing caprolactone in the presence of difunctional active hydrogen compounds such as but not limited to water or low molecular weight glycols as recited herein. Non-limiting examples of suitable polycaprolactone polyols can include commercially available materials designated as the CAPA series from Solvay Chemical which includes but is not limited to CAPA 2047A, and the TONE™ series from Dow Chemical such as but not limited to TONE 0201.

Polycarbonate polyols for use in the present invention are varied and known to one skilled in the art. Suitable polycarbonate polyols can include those commercially available (such as but not limited to Ravecarb™ 107 from Enichem S.p.A.). In a non-limiting embodiment, the polycarbonate polyol can be produced by reacting an organic glycol such as a diol, described hereinafter and in connection with the glycol component of the polyurethane or polyurethane urea, and a dialkyl carbonate, such as described in U.S. Pat. No. 4,160,853. In a non-limiting embodiment, the polyol can include polyhexamethyl carbonate such as $HO—(CH_2)_6—[O—C(O)—O—(CH_2)_6]_n—OH$, wherein n is an integer from 4 to 24, or from 4 to 10, or from 5 to 7.

In a non-limiting embodiment, the glycol material can comprise low molecular weight polyols such as polyols having a number average molecular weight of less than 500 grams/mole, and compatible mixtures thereof. As used herein, the term "compatible" means that the glycols are mutually soluble in each other so as to form a single phase. Non-limiting examples of these polyols can include but are not limited to low molecular weight diols and triols. In a further non-limiting embodiment, the amount of triol chosen can be such to avoid a high degree of cross-linking in the polyurethane or polyurethane urea. In alternate non-limiting embodiments, the organic glycol can contain from 2 to 16, or from 2 to 6, or from 2 to 10, carbon atoms. Non-limiting examples of such glycols can include but are not limited to ethylene glycol, propylene glycol, diethylene glycol, triethylene glycol, tetraethylene glycol, dipropylene glycol, tripropylene glycol, 1,2-, 1,3- and 1,4-butanediol, 2,2,4-trimethyl-1,3-pentanediol, 2-methyl-1,3-pentanediol, 1,3-2,4- and 1,5-pentanediol, 2,5- and 1,6-hexanediol, 2,4-heptanediol, 2-ethyl-1,3-hexanediol, 2,2-dimethyl-1,3-propanediol, 1,8-octanediol, 1,9-nonanediol, 1,10-decanediol, 1,4-cyclohexanediol, 1,4-cyclohexanedimethanol, 1,2-bis (hydroxyethyl)-cyclohexane, glycerin, tetramethylolmethane, pentaerythritol, trimethylolethane and trimethylolpropane; and isomers thereof.

In alternate non-limiting embodiments, the hydroxyl-containing material can have a molecular weight of at least 200 grams/mole, or at least 1000 grams/mole, or at least 2000 grams/mole. In alternate non-limiting embodiments, the hydroxyl-containing material can have a number average molecular weight of less than 10,000 grams/mole, or less than 15,000 grams/mole, or less than 20,000 grams/mole, or less than 32,000 grams/mole.

In a non-limiting embodiment, the hydroxyl-containing material for use in the present invention can include teresters produced from at least one low molecular weight dicarboxylic acid, such as adipic acid.

In a non-limiting embodiment, the hydroxyl-containing material can comprise block polymers including blocks of ethylene oxide-propylene oxide and/or ethylene oxide-butylene oxide. In a non-limiting embodiment, the hydroxyl-containing material can comprise a block polymer of the following chemical formula:

$$HO—(O—CRRCRR—Y_n)_a—(CRRCRR—Y_n—O)_b—(CRRCRR—Y_n—O)_c—H \quad (II)$$

wherein R can represent hydrogen or $C_1$-$C_6$ alkyl; $Y_n$ can represent $C_0$-$C_6$ hydrocarbon; n can be an integer from 0 to 6; a, b, and c can each be an integer from 0 to 300, wherein a, b and c are chosen such that the number average molecular weight of the polyol does not exceed 32,000 grams/mole.

In further alternate non-limiting embodiments, hydroxyl-containing materials such as but not limited to Pluronic.RTM R, Pluronic.RTM , Tetronic.RTM R and Tetronic.RTM Block Copolymer Surfactants, which are commercially available from BASF, can be used as the hydroxyl-containing material in the present invention.

Further non-limiting examples of suitable polyols for use in the present invention can include straight or branched chain alkane polyols, such as but not limited to 1,2-ethanediol, 1,3-propanediol, 1,2-propanediol, 1,4-butanediol, 1,3-butanediol, glycerol, neopentyl glycol, trimethylolethane, trimethylolpropane, di-trimethylolpropane, erythritol, pentaerythritol and di-pentaerythritol; polyalkylene glycols, such as but not limited to diethylene glycol, dipropylene glycol and higher polyalkylene glycols such as but not limited to polyethylene glycols which can have number average molecular weights of from 200 grams/mole to 2,000 grams/mole; cyclic alkane polyols, such as but not limited to cyclopentanediol, cyclohexanediol, cyclohexanetriol, cyclohexanedimethanol, hydroxypropylcyclohexanol and cyclohexanediethanol; aromatic polyols, such as but not limited to dihydroxybenzene, benzenetriol, hydroxybenzyl alcohol and dihydroxytoluene; bisphenols, such as, 4,4'-isopropylidenediphenol; 4,4'-oxybisphenol, 4,4'-dihydroxybenzophenone, 4,4'-thiobisphenol, phenolphthlalein, bis(4-hydroxyphenyl)methane, 4,4'-(1,2-ethenediyl)bisphenol and 4,4'-sulfonylbisphenol; halogenated bisphenols, such as but not limited to 4,4'-isopropylidenebis(2,6-dibromophenol), 4,4'-isopropylidenebis(2,6-dichlorophenol) and 4,4'-isopropylidenebis(2,3,5,6-tetrachlorophenol); alkoxylated bisphenols, such as but not limited to alkoxylated 4,4'-isopropylidenediphenol which can have from 1 to 70 alkoxy groups, for example, ethoxy, propoxy, α-butoxy and β-butoxy groups; and biscyclohexanols, which can be prepared by hydrogenating the corresponding bisphenols, such as but not limited to 4,4'-isopropylidene-biscyclohexanol, 4,4'-oxybiscyclohexanol, 4,4'-thiobiscyclohexanol and bis(4-hydroxycyclohexanol)methane; polyurethane or polyurethane urea polyols, polyester polyols, polyether polyols, poly vinyl alcohols, polymers containing hydroxy functional acrylates, polymers containing hydroxy functional methacrylates, and polymers containing allyl alcohols.

In a non-limiting embodiment, the polyol can be chosen from multifunctional polyols, including but not limited to trimethylolpropane, ethoxylated trimethylolpropane, pentaerythritol.

In alternate non-limiting embodiments, the polyurethane prepolymer can have a number average molecular weight (Mn) of less than 50,000 grams/mole, or less than 20,000 grams/mole, or less than 10,000 grams/mole. The Mn can be determined using a variety of known methods. In a non-limiting embodiment, the Mn can be determined by gel permeation chromatography (GPC) using polystyrene standards.

In alternate non-limiting embodiments, the hydroxyl-containing material for use in the present invention can be chosen from polyether glycols and polyester glycols having a number average molecular weight of at least 200 grams/mole, or at least 300 grams/mole, or at least 750 grams/mole; or no greater than 1,500 grams/mole, or no greater than 2,500 grams/mole, or no greater than 4,000 grams/mole.

In a further non-limiting embodiment, polyether glycols for use in the present invention can include but are not limited to polytetramethylene ether glycol.

In a non-limiting embodiment, the hydroxyl-containing material can include both hydroxyl and thiol groups, such as but not limited to 2-mercaptoethanol, 3-mercapto-1,2-propanediol, glycerin bis(2-mercaptoacetate) and 1-hydroxy-4-mercaptocyclohexane.

In general, polyurethanes and polyurethane prepolymers can be polymerized using a variety of techniques known in the art. In a non-limiting embodiment of the present invention, the polymerization process can include the use of an amine-containing material for curing.

Amine-containing curing agents for use in the present invention are numerous and widely varied. Non-limiting examples of suitable amine-containing curing agents can include but are not limited to aliphatic polyamines, cycloaliphatic polyamines, aromatic polyamines and mixtures thereof. In alternate non-limiting embodiments, the amine-containing curing agent can be a polyamine having at least two functional groups independently chosen from primary amine (—$NH_2$), secondary amine (—NH—) and combinations thereof. In a further non-limiting embodiment, the amine-containing curing agent can have at least two primary amine groups. In another non-limiting embodiment, the amine-containing curing agent can comprise a mixture of a polyamine and at least one material selected from a polythiol and polyol. Non-limiting examples of suitable polythiols and polyols include those previously recited herein. In still another non-limiting embodiment, the amine-containing curing agent can be a sulfur-containing amine-containing curing agent. A non-limiting example of a sulfur-containing amine-containing curing agent can include Ethacure 300 which is commercially available from Albemarle Corporation.

Suitable amine-containing curing agents for use in the present invention can include but are not limited to materials having the following chemical formula:

(III)

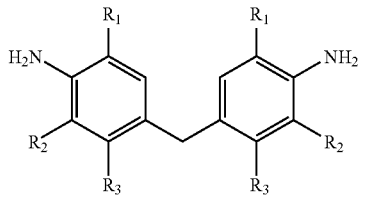

wherein $R_1$ and $R_2$ can each be independently chosen from methyl, ethyl, propyl, and isopropyl groups, and $R_3$ can be chosen from hydrogen and chlorine. Non-limiting examples of amine-containing curing agents for use in the present invention include the following compounds, manufactured by Lonza Ltd. (Basel, Switzerland):

LONZACURE.RTM. M-DIPA: $R_1$=$C_3H_7$; $R_2$=$C_3H_7$; $R_3$=H

LONZACURE.RTM. M-DMA: $R_1$=$CH_3$; $R_2$=$CH_3$; $R_3$=H

LONZACURE.RTM. M-MEA: $R_1$=$CH_3$; $R_2$=$C_2H_5$; $R_3$=H

LONZACURE.RTM. M-DEA: $R_1$=$C_2H_5$; $R_2$=$C_2H_5$; $R_3$=H

LONZACURE.RTM. M-MIPA: $R_1$=$CH_3$; $R_2$=$C_3H_7$; $R_3$=H

LONZACURE.RTM. M-CDEA: $R_1$=$C_2H_5$; $R_2$=$C_2H_5$; $R_3$=Cl wherein $R_1$, $R_2$ and $R_3$ correspond to the aforementioned chemical formula.

In a non-limiting embodiment, the amine-containing curing agent can include but is not limited to a diamine curing agent such as 4,4'-methylenebis(3-chloro-2,6-diethylaniline), (Lonzacure.RTM . M-CDEA), which is available in the United States from Air Products and Chemical, Inc. (Allentown, Pa.). In alternate non-limiting embodiments, the amine-containing curing agent for use in the present invention can include 2,4-diamino-3,5-diethyl-toluene, 2,6-diamino-3,5-diethyl-toluene and mixtures thereof (collectively "diethyltoluenediamine" or "DETDA"), which is commercially available from Albemarle Corporation under the trade name Ethacure 100; dimethylthiotoluenediamine (DMTDA), which is commercially available from Albemarle Corporation under the trade name Ethacure 300; 4,4'-methylene-bis-(2-chloroaniline) which is commercially available from Kingyorker Chemicals under the trade name MOCA. DETDA can be a liquid at room temperature with a viscosity of 156 cPs at 25° C. DETDA can be isomeric, with the 2,4-isomer range being from 75 to 81 percent while the 2,6-isomer range can be from 18 to 24 percent.

Non-limiting examples of amine-containing curing agents can include ethyleneamines. Suitable ethyleneamines can include but are not limited to ethylenediamine (EDA), diethylenetriamine (DETA), triethylenetetramine (TETA), tetraethylenepentamine (TEPA), pentaethylenehexamine (PEHA), piperazine, morpholine, substituted morpholine, piperidine, substituted piperidine, diethylenediamine (DEDA), and 2-amino-1-ethylpiperazine. In alternate non-limiting embodiments, the amine-containing curing agent can be chosen from one or more isomers of $C_1$-$C_3$ dialkyl toluenediamine, such as but not limited to 3,5-dimethyl-2,4-toluenediamine, 3,5-dimethyl-2,6-toluenediamine, 3,5-diethyl-2,4-toluenediamine, 3,5-diethyl-2,6-toluenediamine, 3,5-diisopropyl-2,4-toluenediamine, 3,5-diisopropyl-2,6-toluenediamine, and mixtures thereof. In alternate non-limiting embodiments, the amine-containing curing agent can be methylene dianiline or trimethyleneglycol di(para-aminobenzoate).

In alternate non-limiting embodiments of the present invention, the amine-containing curing agent can include one of the following general structures:

(IV)

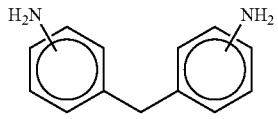

-continued (V)

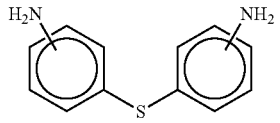

(VI)

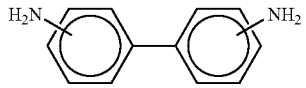

In further alternate non-limiting embodiments, the amine-containing curing agent can include one or more methylene bis anilines which can be represented by the general formulas VII-XI, one or more aniline sulfides which can be represented by the general formulas XII-XVI, and/or one or more bianilines which can be represented by the general formulas XVII-XX, (VII)

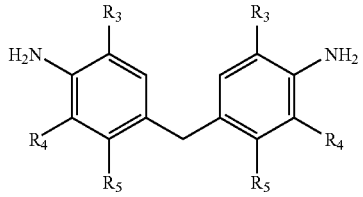

(VIII)

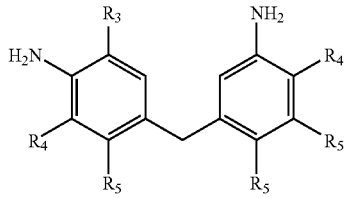

(IX)

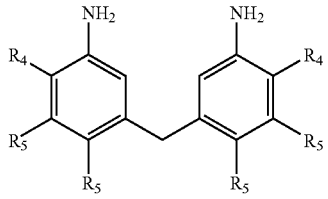

(X)

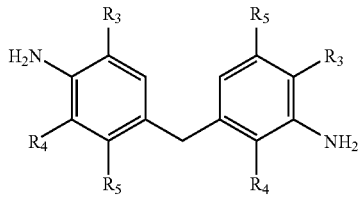

(XI)

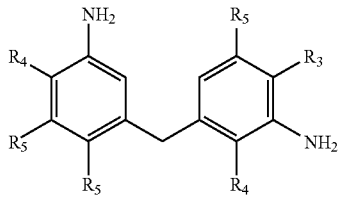

-continued (XII)

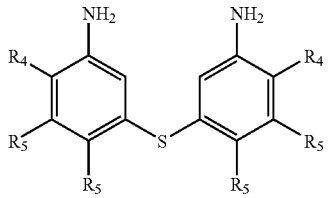

(XIII)

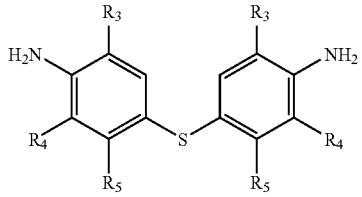

(XIV)

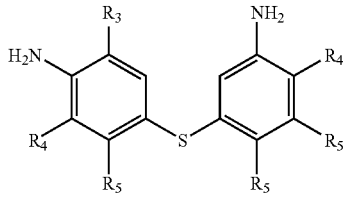

(XV)

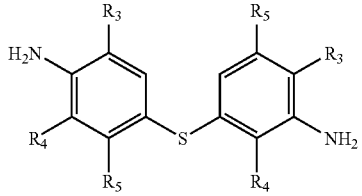

(XVI)

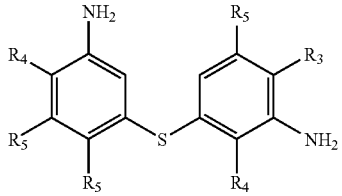

(XVII)

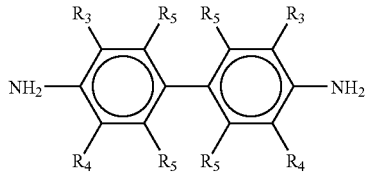

(XVIII)

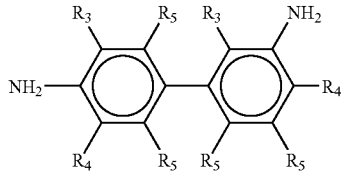

(XIX)

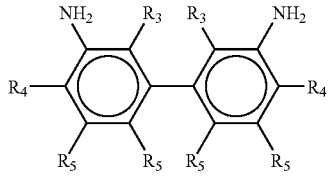

-continued (XX)

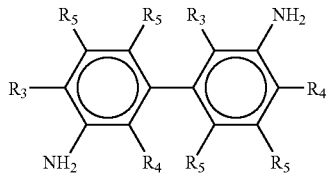

wherein $R_3$ and $R_4$ can each independently represent $C_1$ to $C_3$ alkyl, and $R_5$ can be chosen from hydrogen and halogen, such as but not limited to chlorine and bromine. The diamine represented by general formula VII can be described generally as a 4,4'-methylene-bis(dialkylaniline). Suitable non-limiting examples of diamines which can be represented by general formula VII include but are not limited to 4,4'-methylene-bis(2,6-dimethylaniline), 4,4'-methylene-bis(2,6-diethylaniline), 4,4'-methylene-bis(2-ethyl-6-methylaniline), 4,4'-methylene-bis(2,6-diisopropylaniline), 4,4'-methylene-bis(2-isopropyl-6-methylaniline) and 4,4'-methylene-bis(2,6-diethyl-3-chloroaniline).

In a further non-limiting embodiment, the amine-containing curing agent can include materials which can be represented by the following general structure (XXI):

(XXI)

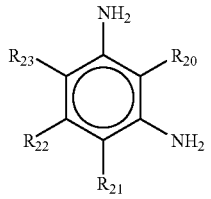

where $R_{20}$, $R_{21}$, $R_{22}$, and $R_{23}$ can be independently chosen from H, $C_1$ to $C_3$ alkyl, $CH_3$—S— and halogen, such as but not limited to chlorine or bromine. In a non-limiting embodiment of the present invention, the amine-containing curing agent which can be represented by general Formula XXI can include diethyl toluene diamine (DETDA) wherein $R_{23}$ is methyl, $R_{20}$ and $R_{21}$ are each ethyl and $R_{22}$ is hydrogen. In a further non-limiting embodiment, the amine-containing curing agent can include 4,4'-methylenedianiline.

In alternate non-limiting embodiments, amine-containing material and blowing agent can be mixed with the polyisocyanate and hydroxyl-containing materials using a variety of methods and equipment, such as but not limited to an impeller or extruder. In a non-limiting embodiment, the mixing equipment can include a mechanical stirrer operating at low pressure such as less than 20 bar. In another non-limiting embodiment, the components can be mixed by impingement mixing wherein the components are injected at high velocity and pressure into a mixing chamber, and the components are then mixed in the chamber by kinetic energy. In this embodiment, the components are typically injected at a velocity of from 100 to 200 meters per second, and a pressure of from 20 to 3000 bar.

In alternate non-limiting embodiments, polyurethane prepolymer and optionally polyisocyanate can be contained in a first feed of a mixing unit, amine-containing material and optionally hydroxyl-containing material in a second feed and the blowing agent in a third feed; or the second feed can include amine-containing material and blowing agent, and optionally hydroxyl-containing material.

In another non-limiting embodiment, the polyurethane urea can be prepared by a one-pot process by combining polyisocyanate, hydroxyl-containing material, amine-containing material and blowing agent. In a further non-limiting embodiment, the polyurethane urea can be prepared by a one-pot process by combining polyisocyanate and polyurethane prepolymer, optionally hydroxyl-containing material, amine-containing material and blowing agent.

In a non-limiting embodiment of the present invention, a mixing unit having three feeds can be used in combining the polyisocyanate and/or polyurethane, hydroxyl-containing material, amine-containing material and blowing agent. The ingredients can be added into the feeds using a variety of configurations. In alternate non-limiting embodiments, the first feed of a mixing unit can contain polyisocyanate and/or polyurethane prepolymer and the second feed can contain hydroxyl-containing material, amine-containing material and blowing agent; or the second feed can contain hydroxyl functional material and amine-containing material, and a third feed can contain blowing agent; or the second feed can contain amine-containing material, and the third feed can contain hydroxyl-containing material and blowing agent; or the second feed can contain hydroxyl-containing material, and the third feed can contain amine-containing material and blowing agent. In a further non-limiting embodiment, wherein polyurethane prepolymer is present in a first feed, the presence of hydroxyl-containing material in another feed is optional.

A blowing agent can be used in the present invention to form cells at least partially filled with gas within the polyurethane urea material. In a non-limiting embodiment, the cells are substantially uniformly distributed throughout the polyurethane urea material. The size of the cells can vary widely. In alternate non-limiting embodiments, a cell can be from at least 1 micron, or at least 20 microns, or at least 30 microns, or at least 40 microns; to less than 1000 microns, or less than 500 microns or less than 100 microns.

In a non-limiting embodiment, the blowing agent can be water. The water can react in-situ with isocyanate (NCO) to produce carbon dioxide. In a further non-limiting embodiment, one or more auxiliary blowing agents can be used in combination with the blowing agent. Suitable auxiliary blowing agents for use in the present invention can vary widely and can include substances which can be substantially volatile at the reaction temperature. The auxiliary blowing agent can be selected from those known in the art. Non-limiting examples can include but are not limited to acetone, ethyl acetate, halogen substituted alkanes such as methylene chloride, chloroform, ethylidene chloride, vinylidene chloride, monofluorotrichloromethane, chlorodifluoromethane, dichlorodifluoromethane, dichloromonofluoromethane, butane, pentane, cyclopentane hexane, heptane, diethylether, and mixtures thereof.

The amount of blowing agent used in the present invention can vary. In alternate non-limiting embodiments, the blowing agent can be present in an amount such that a selected or desired density and/or pore volume of the polishing pad can be achieved. In alternate non-limiting embodiments, the density can be from 0.50 to 1.10 g/cc; the pore volume can be from 5% to 55% based on volume of polyurethane urea material. Density can be measured using a variety of methods known to one of ordinary skill in the art. The density values recited herein are determined in accordance with ASTM 1622-88. Pore volume can also be measured using a variety of methods known to a skilled artisan. The pore volume values recited herein are determined in accordance with ASTM D 4284-88, using an Autopore III mercury porosimeter manufactured by Micromeritics. In a further non-limiting embodiment, the amount of blowing agent can be from 0 to 5% by weight of the reaction mixture.

In a non-limiting embodiment, the amine-containing material can contain at least a small concentration of residual moisture or water sufficient to act as the blowing agent.

In another non-limiting embodiment, a urethane-forming catalyst and/or blowing catalyst can be used in the present invention to enhance the reaction of the polyurethane urea-forming materials, and/or accelerate the reaction with blowing agent. In a further non-limiting embodiment, one or more materials can be used wherein each material can exhibit characteristics of a urethane-forming and blowing catalyst.

Suitable urethane-forming catalysts can vary, for example, suitable urethane-forming catalysts can include those catalysts that are known in the art to be useful for the formation of urethane by reaction of the NCO and OH-containing materials. Non-limiting examples of suitable catalysts can be chosen from the group of Lewis bases, Lewis acids and insertion catalysts as described in Ullmann's Encyclopedia of Industrial Chemistry, $5^{th}$ Edition, 1992, Volume A21, pp. 673 to 674. In a non-limiting embodiment, the catalyst can be a stannous salt of an organic acid, such as but not limited to stannous octoate, dibutyl tin dilaurate, dibutyl tin diacetate, dibutyl tin mercaptide, dibutyl tin dimaleate, dimethyl tin diacetate, dimethyl tin dilaurate, and mixtures thereof. In alternate non-limiting embodiments, the catalyst can be zinc octoate, bismuth, or ferric acetylacetonate.

Non-limiting examples of suitable blowing catalysts can include tertiary amines such as but not limited to 1,4-diazabicyclo[2.2.2]octane, bis-2-dimethyl aminoethyl ether, pentamethyldiethylene triamine, triethylamine, triisopropylamine, N-methylmorpholine and N,N-dimethylbenzylamine. Such suitable tertiary amines are disclosed in U.S. Pat. No. 5,693,738 at column 10, lines 6-38, the disclosure of which is incorporated herein by reference. Tertiary amine catalysts may also include those containing hydroxyl functionality such as N,N-dimethylethanolamine, 2-(2-dimethylaminoethoxy-)ethanol, N,N,N'-trimethyl-N'-hydroxyethylbisaminoether, N,N-(dimethyl)-N,N'-diisopropanol-1,3-propanediamine, and N,N-bis-(3-dimethylaminopropyl)-N-isopropanolamine.

In a non-limiting embodiment the catalyst can be chosen from phosphines, tertiary ammonium salts and tertiary amines, such as but not limited to tributyl phosphine, triethylamine; triisopropylamine and N,N-dimethylbenzylamine. Additional non-limiting examples of suitable tertiary amines are disclosed in U.S. Pat. No. 5,693,738 at column 10 lines 6 through 38, the disclosure of which is incorporated herein by reference.

In another non-limiting embodiment, a surfactant can be present during polymerization. Surfactants can influence the formation and stabilization of the at least partially gas-filled cells. In a non-limiting embodiment, the surfactant can be selected such that it has high surface activity for nucleation and stabilization of the cells. In another non-limiting embodiment, the surfactant can be selected such that it has good emulsifying abilities for a blowing agent. Suitable surfactants for use in the present invention are wide and varied. In a non-limiting embodiment, a silicone surfactant can be used. The silicone surfactant can be selected from siloxane-polyoxyalkylene copolymer surfactants. Non-limiting examples of such surfactants can include but are not limited to polydimethylsiloxane-polyoxyalkylene block copolymers which are available from GE Silicons Incorporated under the designations Niax RTM. Silicone L-1800, L-5420 and L-5340; Dow Corning Corporation under the designations DC-193, DC-5357 and DC-5315; and Goldschmidt Chemical Corporation under the designations B-8404 and B-8407.

In a further non-limiting embodiment, the siloxane-polyoxyalkylene copolymer surfactant can be represented by the following general formula,

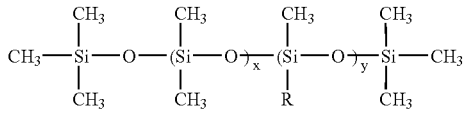

(XXII)

wherein x is a number from 1 to 150, y is a number of from 1 to 50, the ratio of x:y is from 10:1 to 1:1 and R is an alkyl alkoxylate. With reference to the general formula I, x can be from 10 to 50, or from 10 to 42, or from 13 to 42; and y can be from 2 to 20, or from 5 to 20, or from 7 to 20, or from 7 to 10. The ratio of x:y can be between 2.4 and 6.8.

wherein R can be an alkyl alkoxylate which can be represented by the following general formula XXIII, $$R'O(C_2H_4O)_m(C_3H_6O)_nH \qquad \text{XXIII}$$

wherein R' is an alkylene group containing from 3 to 6 carbon atoms, m is a number of from 5 to 200, and n is a number of from 0 to 20, or from 2 to 18. The molecular weight of R is in the range of from 400 to 4000, and the molecular weight of the surfactant represented by general formula XXII can be from 6,000 to 50,000.

The siloxane-polyoxyalkylene copolymer surfactant can be prepared as described in U.S. Pat. No. 5,691,392, column 3, line 25 through column 4, line 18, which is incorporated herein by reference.

The amount of surfactant useful in the present invention can vary widely. In alternate non-limiting embodiments, the amount is such that the surfactant is from 0.001% to 10%, or 0.01% to 1%, or from 0.05% to 0.5% by weight of the reaction mixture.

In another non-limiting embodiment, a nucleating agent can be used during polymerization in preparing the polyurethane urea of the present invention. Suitable nucleating agents for use in the present invention can include materials which enhance the generation of relatively small substantially uniform cells. The nucleating agent can be selected from those known in the art. Non-limiting examples can include but are not limited to relatively small size polymer particles (e.g., ten microns or less) such as but not limited to polypropylene, polyethylene, polystyrene, polyurethane, polyester, and polyacrylates. The amount of nucleating agent used can vary widely. In general, the nucleating agent can be used in an amount which is effective to generate said cells. In alternate non-limiting embodiments, the nucleating agent can be present in an amount of from 0.01% to 1.00%, or from 0.05% to 0.5%, by weight of the reaction mixture.

In a non-limiting embodiment, feeds containing polyisocyanate and/or polyurethane prepolymer, hydroxyl-containing material, amine-containing material, blowing agent and any optional additives can be directed into a mixing unit. Optional additives can include a wide variety of additives known to one having ordinary skill in the art. Non-limiting examples can include but are not limited to antioxidants, hindered amine UV stabilizers, UV absorbers, plasticizers, internal mold release agents, dyes and pigments. In further alternate non-limiting embodiments, any or all of the feeds can be heated to reduce the viscosity of the feeds and/or the resulting mixture. The reaction mixture exiting the mixing unit can then be poured into an open cavity to form a polishing pad. In a non-limiting embodiment, the cavity can be controlled to a temperature of from 22° C. to 150° C., or from 60° C. to 110° C.

The polishing pad of the present invention can have one or more work surfaces, wherein "work surface" as used herein and the claims refers to a surface of the pad that can come into contact with the surface of the article that is to be polished and a polishing slurry. In a non-limiting embodiment, the article to be polished can be a silicon wafer. In further non-limiting embodiments, the work surface of the polishing pad can have surface features such as but not limited to channels, grooves, perforations and combinations thereof.

Surface features can be incorporated into the work surface of the polishing pad by means that are known to those of ordinary skill in the art. In a non-limiting embodiment, the work surface of the pad can be mechanically modified, for example, by abrading or cutting. In another non-limiting embodiment, surface features can be incorporated into the work surface of the pad during the molding process, for example, by providing at least one interior surface of the mold with raised features that can be imprinted into the work surface of the pad during its formation. Surface features can be distributed in the form of random or uniform patterns across the work surface of the polishing pad. Non-limiting examples of surface feature patterns can include but are not limited to spirals, circles, squares, cross-hatches and waffle-like patterns.

In a non-limiting embodiment, the polyurethane urea can comprise an abrasive particulate material. The abrasive particulate material can be distributed substantially uniformly or non-uniformly throughout the polyurethane urea. In alternate non-limiting embodiments, the abrasive particulate material can be present in an amount of less than 70 percent by weight, or at least 5 percent by weight, or from 5 percent to 65 percent by weight, based on the total weight of the polishing pad.

In alternate non-limiting embodiments, the abrasive particulate material can be in the form of individual particles, aggregates of individual particles, or a combination of individual particles and aggregates. In further alternate non-limiting embodiments, the shape of the abrasive particulate material can include but is not limited to spheres, rods, triangles, pyramids, cones, regular cubes, irregular cubes, and mixtures and/or combinations thereof.

In general, the average particle size of the abrasive particulate material can vary widely. In alternate non-limiting embodiments, the average particle size can be at least 0.001 micron, or at least 0.01 micron, or at least 0.1 micron. In further alternate non-limiting embodiments, the average particle size of the abrasive particulate material can be less than 50 microns, or less than 10 microns, or less than 1 micron. In a non-limiting embodiment, the average particle size of the abrasive particulate material can measured along the longest dimension of the particle.

Non-limiting examples of suitable abrasive particulate materials for use in the present invention can include aluminum oxide, such as but not limited to gamma alumina, fused aluminum oxide, heat treated aluminum oxide, white fused aluminum oxide, and sol gel derived alumina; silicon carbide, such as but not limited to green silicon carbide and black silicon carbide; titanium diboride; boron carbide; silicon nitride; tungsten carbide; titanium carbide; diamond; boron nitride, such as but not limited to cubic boron nitride and hexagonal boron nitride; garnet; fused alumina zirconia; silica, such as but not limited to fumed silica; iron oxide; cromia; ceria; zirconia; titania; tin oxide; manganese oxide; and mixtures thereof. In a further non-limiting embodiment, the abrasive particulate material can be chosen from aluminum oxide, silica, cerium oxide, zirconia and mixtures thereof.

In a non-limiting embodiment, the abrasive particulate material used in the present invention can have a surface modifier thereon. Non-limiting examples of suitable surface modifiers can include surfactants, coupling agents and mixtures thereof. In a non-limiting embodiment, surfactants can be used to improve the dispersibility of the abrasive particles in the polyurethane urea. In another non-limiting embodiment, coupling agents can be used to enhance binding of the abrasive particles to the matrix of the polyurethane urea. In further non-limiting embodiments, the surface modifier can be present in an amount of less than 25 percent by weight, or from 0.5 to 10 percent by weight, based on the total weight of the abrasive particulate material and surface modifier.

Non-limiting examples of suitable surfactants for use as surface modifiers in the present invention can include anionic, cationic, amphoteric and nonionic surfactants, such as but not limited to metal alkoxides, polalkylene oxides, salts of long chain fatty carboxylic acids. Non-limiting examples of suitable coupling agents for use in the present invention can include silanes, such as but not limited to organosilanes, titanates and zircoaluminates. In a non-limiting embodiment, the coupling agent can include SILQUEST Silanes A-174 and A-1230, which are commercially available from Witco Corporation.

The polishing pad of the present invention can have shapes chosen from but not limited to circles, ellipses, squares, rectangles and triangles. In a non-limiting embodiment, the polishing pad can be in the form of a continuous belt. The polishing pads according to the present invention can have a wide range of sizes and thicknesses. In a non-limiting embodiment, a circular polishing pad can have a diameter ranging from 3.8 cm to 137 cm. In a further non-limiting embodiment, the thickness of the polishing pad can vary from 0.5 mm to 5 mm.

In a non-limiting embodiment, the polishing pad of the present invention can have a density of from 0.5 grams per cubic centimeter (g/cc) to 1.1 g/cc as measured by ASTM 1622-88. In another non-limiting embodiment, the polishing pad can have a Shore A Hardness value of at least 80, or from 85 to 98, and Shore D Hardness value of at least 35, or 85 or less, or from 45 to 80, as determined in accordance with ASTM D 2240.

While not intending to be bound by any theory, it is believed that when in use, while polishing or planarizing the surface of a silicon wafer, the porosity of the work surface of the polishing pad of the present invention can remain substantially constant. As the work surface of the polishing pad is worn away during, for example a polishing or pad conditioning process, new surface pores are formed as those embedded pores residing proximately below the work surface are exposed. Further, as the work surface of the polishing pad is worn away during the polishing process, the gas contained within the at least partially gas-filled cells can be exposed. The gas can be released into the work environment and the remaining void(s) can be at least partially filled with polishing slurry.

In a non-limiting embodiment, the polishing pad can be placed directly on the platen of a motorized polishing tool, machine, or apparatus. In a further non-limiting embodiment, the polishing pad can be included in a polishing pad assembly, wherein a backing layer can be adhered to the back surface of the polishing pad. In a non-limiting embodiment, a polishing pad assembly can comprise:

(a) a polishing pad having a work surface and a back surface;

(b) a backing layer having an upper surface and a lower surface; and (c) an adhesive means interposed between and in contact with at least a portion of the back surface of said polishing pad and at least a portion of the upper surface of said backing layer.

In a non-limiting embodiment, the backing sheet of the polishing pad assembly can be rigid or flexible, and can support or stabilize or cushion the polishing pad during polishing operations. The backing sheet can be fabricated from materials that are known to the skilled artisan. In alternate non-limiting embodiments, the backing sheet can be fabricated from organic polymeric materials, such as but not limited to polyesters, such as polyethylene terephthalate sheet, and polyolefins, such as polyethylene sheet and polypropylene sheet.

In another non-limiting embodiment, the backing sheet of the polishing pad assembly of the present invention can be a release sheet, which can be peeled away from the adhesive means, thereby allowing the pad to be adhered to another surface, for example, the platen of a polishing apparatus, by means of the exposed adhesive means. In general, release sheets are known to those of ordinary skill in art. In a non-limiting embodiment, the release sheet can be fabricated from paper or organic polymeric materials, such as but not limited to polyethylene terephthalate sheet, polyolefins, for example, polyethylene sheet and polypropylene sheet, and fluorinated polyolefins, for example, polytetrafluoroethylene. In a further non-limiting embodiment, the upper surface of the release sheet can comprise a release coating thereon that can be in contact with the adhesive means. Release coatings are well known to the skilled artisan. Non-limiting examples of release coatings can include fluorinated polymers and silicones.

The adhesive can be chosen from a wide variety of adhesive materials known in the art. A suitable adhesive for use in the present invention can provide sufficient peel resistance such that the pad layers essentially remain in place during use. Further, the adhesive can be selected to sufficiently withstand shear stresses which are present during the polishing or planarization process and moreover, can sufficiently resist chemical and moisture degradation during use. The adhesive can be applied using conventional techniques known to the skilled artisan. In a non-limiting embodiment, the adhesive can be applied to a lower surface of the polishing pad and/or an upper surface of the backing layer which are parallel facing to one another.

Non-limiting examples of suitable adhesive means can include but not limited to contact adhesives, pressure sensitive adhesives, structural adhesives, hot melt adhesives, thermoplastic adhesives, and curable adhesives, such as thermosetting adhesives. Non-limiting examples of structural adhesives can be chosen from polyurethane adhesives, and epoxy resin adhesives; such as those based on the diglycidyl ether of bisphenol A. Non-limiting examples of pressure sensitive adhesives can include an elastomeric polymer and a tackifying resin.

The elastomeric polymer can be chosen from natural rubber, butyl rubber, chlorinated rubber, polyisobutylene, poly(vinyl alkyl ethers), alkyd adhesives, acrylics such as those based on copolymers of 2-ethylhexyl acrylate and acrylic acid, block copolymers such as styrene-butadiene-styrene, and mixtures thereof. In a non-limiting embodiment, a pressure sensitive adhesive can be applied to a substrate using an organic solvent such as toluene or hexane, or from a water-based emulsion or from a melt. As used herein, "hot melt adhesive" refers to an adhesive comprised of a nonvolatile thermoplastic material that can be heated to a melt, then applied to a substrate as a liquid. Non-limiting examples of hot melt adhesives can be chosen from ethylene-vinyl acetate copolymers, styrene-butadiene copolymers, ethylene-ethyl acrylate copolymers, polyesters, polyamides such as those formed from the reaction of a diamine and a dimer acid, and polyurethanes.

In a non-limiting embodiment, the adhesive layer can be applied to the back surface of the polishing pad and/or the upper surface of the backing sheet, prior to pressing the polishing pad and backing sheet together.

In alternate non-limiting embodiments, the adhesive means of the polishing pad assembly can be selected from an adhesive assembly or an adhesive layer.

In further non-limiting embodiment, the adhesive assembly can comprise an adhesive support sheet interposed between an upper adhesive layer and a lower adhesive layer. The upper adhesive layer of the adhesive assembly can be in contact with the back surface of the polishing pad, and the lower adhesive layer can be in contact with the upper surface of the backing sheet. Non-limiting examples of adhesive support sheets can be fabricated from an organic polymeric material, such as but not limited to polyesters, for example, polyethylene terephthalate sheet, and polyolefins, for example, polyethylene sheet and polypropylene sheet. In a further non-limiting embodiment, the upper and lower adhesive layers of the adhesive assembly can be chosen from those adhesives as recited previously herein with regard to the adhesive layer. In a non-limiting embodiment, the upper and lower adhesive layers can each be contact adhesives. In a further non-limiting embodiment, the adhesive assembly can be a two-sided or double-coated tape, such as but not limited to double-coated film tapes, which can be commercially obtained from 3M, Industrial Tape and Specialties Division.

In another non-limiting embodiment, the polishing pad can be connected to at least a portion of a second layer to produce a stacked pad assembly. In a further non-limiting embodiment, the polishing pad can be connected to at least a portion of the second layer using an adhesive material. Non-limiting examples of suitable adhesive materials include those previously disclosed herein. In a further non-limiting embodiment, the second layer can comprise an adhesive assembly.

The second layer can include a variety of materials known in the art. The second layer can be selected from substantially non-volume compressible polymers and metallic films and foils. As used herein and the claims, "substantially non-volume compressible" means that the volume can be reduced by less than 1% when a load of 20 psi is applied.

Non-limiting examples of substantially non-volume compressible polymers can include polyolefins, such as but not limited to low density polyethylene, high density polyethylene, ultra-high molecular weight polyethylene and polypropylene; polyvinylchloride; cellulose-based polymers, such as but not limited to cellulose acetate and cellulose butyrate; acrylics; polyesters and co-polyesters, such as but not limited to PET and PETG; polycarbonate; polyamides, such as but not limited to nylon 6/6 and nylon 6/12; and high performance plastics, such as but not limited to polyetheretherketone, polyphenylene oxide, polysulfone, polyimide, and polyetherimide; and mixtures thereof.

Non-limiting examples of metallic films can include but are not limited to aluminum, copper, brass, nickel, stainless steel, and combinations thereof.

The thickness of the second layer can vary. In alternate non-limiting embodiments, the second layer can have a thickness of at least 0.0005, or at least 0.0010; or 0.0650 inches or less, or 0.0030 inches or less.

In a non-limiting embodiment, the second layer can be flexible to enhance or increase the uniformity of contact between the polishing pad and the surface of the substrate being polished. A consideration in selecting the material for the second layer can be the capability of a material to provide compliant support to the work surface of the polishing pad such that the polishing pad substantially conforms to the macroscopic contour or long-term surface of the device being polished. A material having said capability can be desirable for use as the second layer in the present invention.

The flexibility of the second layer can vary. The flexibility can be determined using a variety of conventional techniques known in the art. As used herein and the claims the term "flexibility" (F) refers to the inverse relationship of the second layer thickness cubed ($t^3$) and the flexural modulus of the second layer material (E), i.e. $F=1/t^3E$. In alternate non-limiting embodiments, the flexibility of the second layer can be at least 0.5 $in^{-1}lb^{-1}$; or at least 100 $in^{-1}lb^{-1}$; or from 1 $in^{-1}lb^{-1}$ to 100 $in^{-1}lb^{-1}$.

In a non-limiting embodiment, the second layer can have a compressibility which allows the polishing pad to substantially conform to the surface of the article to be polished. The surface of a microelectronic substrate, such as a semiconductor wafer, can have a "wave" contour as a result of the manufacturing process. It is contemplated that if the polishing pad cannot adequately conform to the "wave" contour of the substrate surface, the uniformity of the polishing performance can be degraded. For example, if the pad substantially conforms the ends of the "wave", but cannot substantially conform and contact the middle portion of the "wave", only the ends of the "wave" can be polished or planarized and the middle portion can remain substantially unpolished or unplanarized.

The compressibility of the second layer can vary. The term "compressibility" refers to the percent volume compressibility measurement when a load of 20 psi is applied. In alternate non-limiting embodiments, the percent volume compressibility of the second layer can be at least one percent; or three percent or less; or from one to three percent. The percent volume compressibility can be determined using a variety of conventional methods known in the art.

In a non-limiting embodiment, the second layer is substantially non-volume compressible.

In another non-limiting embodiment, the second layer can distribute the compressive forces experienced by the polishing pad over a larger area of a sub-pad.

In another non-limiting embodiment, the second layer can function as a substantial barrier to fluid transport between the polishing pad and a sub-pad at least partially connected to the second layer. Thus, a consideration in selecting the material comprising the second layer can be the ability of the material to substantially reduce, minimize or essentially prevent the transport of polishing slurry from the polishing pad to a sub-pad. In a non-limiting embodiment, the second layer can be substantially impermeable to the polishing slurry such that the sub-pad does not become saturated with polishing slurry.

In an alternate non-limiting embodiment, the second layer can be perforated such that polishing slurry can penetrate the polishing pad and second layer to wet the sub-pad. In a further non-limiting embodiment, the sub-pad can be substantially saturated with polishing slurry. The perforations in the second layer can be formed by a variety of techniques known to the skilled artisan, such as but not limited to punching, die cutting, laser cutting or water jet cutting. The hole size, number and configuration of the perforations can vary. In a non-limiting embodiment, the perforation hole diameter can be at least 1/16 inch with at least 26 holes per square inch in a staggered-hole pattern.

In another non-limiting embodiment, the polishing pad of the present invention can be connected to at least a portion of a sub-pad forming a composite or multi-layered structure. In a further non-limiting embodiment, the polishing pad can be connected to at least a portion of a sub-pad using an adhesive material. Non-limiting examples of suitable adhesive materials can include those previously described herein.

In a non-limiting embodiment, a sub-pad can be used with a polishing pad to increase the uniformity of contact between the polishing pad and the surface of the substrate which is being polished. The sub-pad can be made of a compressible material capable of imparting substantially even pressure to the work surface of the polishing pad. Non-limiting examples of sub-pads can include but are not limited to polyurethane and polyurethane urea such as but not limited to polyurethane or polyurethane urea impregnated felt; and foam sheet made of natural rubber, synthetic rubber, thermoplastic elastomer essentially resilient foam sheet; or combinations thereof.

In alternate non-limiting embodiments, the material of the sub-pad can be foamed or blown to produce a porous structure. The porous structure can be open cell, closed cell, or combinations thereof.

Non-limiting examples of synthetic rubbers can include neoprene rubber, silicone rubber, chloroprene rubber, ethylene-propylene rubber, butyl rubber, polybutadiene rubber, polyisoprene rubber, EPDM polymers, styrene-butadiene copolymers, copolymers of ethylene and ethyl vinyl acetate, neoprene/vinyl nitrile rubber, neoprene/EPDM/SBR rubber, and combinations thereof. Non-limiting examples of thermoplastic elastomers can include polyurethanes such as those based on polyethers and polyesters, and copolymers thereof. Non-limiting examples of foam sheet can include ethylene vinyl acetate sheets and polyethylene foam sheets; polyurethane foam sheets and polyolefin foam sheets, such as but not limited to those which are available from Rogers Corporation, Woodstock, Conn.

In a further non-limiting embodiment, the sub-pad can include non-woven or woven fiber mat, and combinations thereof; such as but not limited to polyolefin, polyester, polyamide, or acrylic fibers, which have been impregnated with a resin. The fibers can be staple or substantially continuous in the fiber mat. Non-limiting examples can include but are not limited to non-woven fabric impregnated with polyurethane, such as polyurethane impregnated felt. A non-limiting example of a commercially available non-woven sub-pad can be Suba™ IV, from Rodel, Inc. Newark Del.

The thickness of the sub-pad can vary. In general, the sub-pad thickness should be such that the stacked pad is not too thick. A stacked pad which is too thick can be difficult to place on and take off of the planarization equipment. Thus, in a non-limiting embodiment, the thickness of the sub-pad can be from 0.2 to 2 mm.

In a non-limiting embodiment, the polishing pad of the present invention can comprise a sub-pad, and the sub-pad can function as the bottom layer of the pad which can be attached to the platen of the polishing apparatus.

In a non-limiting embodiment, the sub-pad can be substantially nonporous and substantially impermeable to polishing slurry. As used herein and the claims, the term "substantially nonporous" means generally impervious to the passage of liquid, gas, and bacteria. On a macroscopic scale, a substantially nonporous material exhibits few if any pores. As used herein and the claims, the term "porous" means having pore(s) and the term "pore(s)" refers to minute opening(s) through which matter passes.

In a non-limiting embodiment, the sub-pad can be connected to at least a portion of the polishing pad. In a further non-limiting embodiment, the polishing pad can be connected to at least a portion of a second layer, and the second layer can be connected to at least a portion of a sub-pad.

In a non-limiting embodiment, the polishing pad of the present invention can be used in combination with polishing slurries which are known in the art. Non-limiting examples of suitable slurries for use with the pad of the present invention, include but are not limited to the slurries disclosed in U.S. patent application having Ser. Nos. 09/882,548 and 09/882,549, which were both filed on Jun. 14, 2001 and are pending. In a non-limiting embodiment, the polishing slurry can be interposed between the polishing pad and the substrate to be polished. The polishing or planarizing process can include moving the polishing pad relative to the substrate being polished. A variety of polishing slurries are known in the art. Non-limiting examples of suitable slurries for use in the present invention include slurries comprising abrasive particles. Abrasives that can be used in the slurries include particulate cerium oxide, particulate alumina, particulate silica and the like. Examples of commercial slurries for use in the polishing of semiconductor substrates include but are not limited to ILD1200 and ILD1300 available from Rodel, Inc. Newark Del. and Semi-Sperse AM100 and Semi-Sperse 12 available from Cabot Microelectronics Materials Division.

In a non-limiting embodiment, the window of the polishing pad of the present invention can be prepared using a cast-in-place process. This process can include forming an aperture in the polishing pad. The polishing pad can include a pair of spaced surfaces. The aperture can extend through said surfaces. The aperture can be made using a variety of methods identified previously herein. A spacer then can be inserted in the aperture of the pad. The aperture can be sealed at one end. In non-limiting alternate embodiments, the spacer can be temporary and can be removed following formation of the window, or the spacer can be permanent and remain intact following formation of the window. The material, size and shape of the spacer can vary widely. In a non-limiting embodiment, the spacer can be constructed of a material that is at least partially transparent. In another non-limiting embodiment, the spacer can be constructed of polyester film. In general, the size and shape of the spacer can be such that it fits securely in the aperture of the pad. In a non-limiting embodiment, the spacer can be at least partially connected to the material used to seal the opening. In a further non-limiting embodiment, an adhesive tape can be used to seal the opening and the spacer can be at least partially adhered to an adhesive portion of the tape.

The aperture above the spacer can be filled with a resin material to form an at least partially transparent panel within the aperture which is at least partially connected to the pad. In a non-limiting embodiment, the resin can be poured into the aperture above the spacer such that the introduction of air voids into the resin is minimized. In another non-limiting embodiment, the amount of resin used can be such that the resin level is essentially flush with a surface of the pad. In a further non-limiting embodiment, the resin level is essentially flush with the work surface of the pad. In another non-limiting embodiment, the bottom surface of the spacer can be essentially flush with the outer surface of the polishing pad.

In a non-limiting embodiment, the resin material can be selected such that the resulting window formed can be at least partially transparent to the wavelengths of the in-situ metrology instrumentation of a polishing apparatus. In a further non-limiting embodiment, the window formed can be substantially transparent. Suitable resin materials can comprise materials known to one having ordinary skill in the art that either is at least partially transparent or can be made at least partially transparent. Non-limiting examples of resin materials for use in the present invention can include but are not limited to polyurethane prepolymers with curative, epoxy resins with curative, ultraviolet curable acrylics, and mixtures thereof. Non-limiting examples of suitable materials for the resin can include thermoplastic acrylic resins, thermoset acrylic resins, such as hydroxyl-functional acrylic resins crosslinked with urea-formaldehyde or melamine-formaldehyde resins, hydroxyl-functional acrylic resins crosslinked with epoxy resins,or carboxyfunctional acrylic resins crosslinked with carbodiimides or polyimines or epoxy resins; urethane systems, such as hydroxyfunctional acrylic resin crosslinked with polyisocyanate; diamine cured isocyanate-terminated prepolymers; isocyanate-terminated prepolymers crosslinked with polyamines; amine-terminated resins crosslinked with polyisocyanates; carbamate-functional acrylic resins crosslinked with melamine-formaldehyde resins; epoxy resins, such as polyamide resin crosslinked with bisphenol A epoxy resins, phenolic resins crosslinked with bisphenol A epoxy resins; polyester resins, such as hydroxyl-terminated polyesters crosslinked with melamine-formaldehyde resins or with polyisocyanates or with epoxy crosslinkers, and mixtures thereof.

In a non-limiting embodiment, the resin material can comprise amine-terminated oligomer such as VERSALINK P650 which is commercially available from Air Products and Chemicals, Inc., diamine such as LONZACURE MCDEA which is commercially available from Air Products and Chemicals, Inc., and polyisocyanate such as DESMODUR N 3300A which is commercially available from Bayer Corporation Coatings and Colorants Division.

In alternate non-limiting embodiments, the resin material for use in the present invention can include various conventional additives known in the art. Non-limiting examples can include but are not limited to processing aids and degassing aids.

In a further non-limiting embodiment, the resin which can be used to form the panel in the aperture of the pad can be cured. The curing process can include allowing the pad containing the resin to set for a specified amount of time at a specified temperature. The time and temperature used to cure the window resin can vary widely and can depend on the resin material chosen to form the window. Generally, a cure time can be chosen such that the resin is not tacky or sticky to the touch. In general, a cure temperature can be chosen such that warp or deformation of the window which can be produced due to a cure temperature that is too low or too high does not render the pad inoperable for the purpose of polishing an object. In a non-limiting embodiment, the cure time can be from 30 minutes to 48 hours, or from 18 hours to 36 hours, or from 6 hours to 24 hours, or from 1 hour to 4 hours. In a non-limiting embodiment, the cure temperature can be from 0° C. to less than 125° C., or from 5° C. to 120° C., or from 10° C. to 115° C., or from 15° C. to 110° C., or from 22° C. to 105° C.

In a non-limiting embodiment, the aperture can be at least partially filled with a resin material; and the resin material can be cured/polymerized to form a polymer panel to function as the window of the pad. In another non-limiting embodiment, the window can include a polymer panel wherein the polymer is derived from a resin material.

Following the curing step, the spacer and the adhesive tape which was used to seal the opening, can be removed. In an alternate non-limiting embodiment, following the curing step only the adhesive tape can be removed and the spacer can remain in tact. In a non-limiting embodiment, the resulting window area can be made coplanar with the pad work surface using a milling machine.

In a non-limiting embodiment, the backing layer can be at least partially connected to the work surface of the pad using an adhesive means as previously described herein, and a window can be formed in this pad assembly by using the cast-in-place process as previously described herein. In this embodiment, the aperture can extend through the lower surface of the backing layer through the adhesive means and through the work surface of the pad.

In a non-limiting embodiment, a second layer can be at least partially connected to the polishing pad and, an aperture can be formed in the polishing pad and second layer of a stacked pad as previously described for the polishing pad. The aperture then can be sealed on the side of the second layer that is not at least partially connected to the polishing pad. The material used to seal-off the aperture can be chosen from a wide variety of materials known in the art. Suitable materials can include but are not limited to adhesive materials such as adhesive tape.

In a non-limiting embodiment, the polishing pad can include a stacked pad assembly which comprises additional layers. Each additional layer can contain an aperture and the aperture(s) can be substantially aligned with the aperture of the polishing pad. In a non-limiting embodiment, a stacked pad assembly can have three layers. In a further embodiment, the layers can include a polishing pad, a second layer and a sub-pad. The three layers can be at least partially connected to one another as previously described herein (i.e., the polishing pad connected to at least a portion of the second layer, and the second layer connected to at least a portion of the sub-pad).

In a further non-limiting embodiment, a 22.0" diameter SUBA IV subpad commercially available from Rodel, Incorporated can comprise the sub-pad. An aperture can be formed in the subpad, and the aperture can at least partially align with the aperture of the second layer and the aperture of the polishing pad. In a further non-limiting embodiment, the aperture can be rectangular in shape, having dimensions of 0.5"×2.0", being positioned with the long axis radially-oriented and centered 4" from the center of the pad. In alternate non-limiting embodiments, the aperture(s) can be formed in the layers prior to at least partially connecting the layers, or the aperture can be formed following at least partially connecting the layers. In a non-limiting embodiment, the polishing pad can be at least partially connected to the second layer, an aperture can be formed in the polishing pad and second layer, the release liner of the second layer can be removed, and the exposed adhesive can be used to at least partially connect the second layer to the SUBA IV sub-pad. An aperture can be formed in the sub-pad prior to or after at least partially connecting the sub-pad to the polishing pad and second layer assembly. The aperture in the sub-pad can be at least partially aligned with the aperture in the other two layers. A spacer can be inserted into the aperture of the assembly, and the aperture above the spacer can be filled with resin to form a window as previously described herein.

In another non-limiting embodiment, the window can be formed in the polishing pad and second layer assembly as previously described herein, and the sub-pad containing an aperture then can be at least partially connected to the assembly such that the aperture in the sub-pad is at least partially aligned with the at least partially transparent panel in the polishing pad and second layer.

Depending on the material of which the spacer is constructed, the spacer can remain in the window area or it can be removed. In alternate non-limiting embodiments, the spacer can be constructed of a material that is at least partially transparent, or substantially transparent, or transparent to at least one wavelength from 190 to 3500 nanometers, and the spacer can remain in the window pad assembly. In another non-limiting embodiment, the spacer can be constructed of a material that may not be at least partially transparent, and the spacer can be removed. A wide variety of known materials are suitable for use as a spacer in the present invention. Non-limiting examples can include but are not limited to polyesters, polyethylene teraphalate sheet, polyolefins such as but not limited to polyethylene sheet, polyamides, acrylics and combinations thereof. In a non-limiting embodiment of the invention, the spacer can be removed from the window area.

In another non-limiting embodiment, the spacer can be positioned such that it is not flush with the outer surface of the sub-pad.

The window pad of the present invention can be used with a variety of polishing equipment known in the art. In a non-limiting embodiment, a Mirra polisher, produced by Applied Materials Inc, Santa Clara Calif., can be used wherein the shape of the opening is a rectangle, having a size 0.5"×2", being positioned with the long axis radially-oriented and centered 4" from the center of the pad. The platen for the Mirra polisher is 20" in diameter. A pad for use with this polisher can comprise a circle of a 20-inch diameter having a window located in the area as described.

In a further non-limiting embodiment, a Teres polisher commercially available from Lam Research Corporation, Fremont, Calif., can be employed. This polisher uses a continuous belt instead of a circular platen. The pad for this polisher can be a continuous belt of 12" width and 93.25" circumference, which has a window area suitably sized and positioned to align with the metrology window of the Teres polisher can be such that it can be at least partially aligned with the at least partially transparent window in the second layer.

The present invention is more particularly described in the following examples, which are intended to be illustrative only, since numerous modifications and variations therein will be apparent to those skilled in the art. Unless otherwise specified, all parts and all percentages are by weight.

EXAMPLES

Example 1

36.00 kilograms of Airthane PHP-75D polyurethane prepolymer, 1.26 kilograms of Desmodur N 3300A and 0.19 kilograms of Niax L-1800 surfactant were charged into the first tank of a Baulé three-component low pressure dispensing machine and held at 140° F. with 15 PSI of nitrogen pressure. This tank was mixed with low agitation. A curative mixture was prepared by melting 35.5 kilograms of Lonzacure MCDEA at a temperature of 210° F. then 5.5 kilograms of Versalink P-250 were added with stirring. Next, 0.21 kilograms of Niax L1800 added and stirred until uniformly mixed. This curative mixture was then charged into the second tank and held at 210° F. with 40 psi of nitrogen pressure and mixed with low aggitation. Then a mixture of 219 grams Versalink P-650, 60 grams of DABCO BL-19 catalyst and 21 grams of deionized water were charged into the third tank at ambient temperature and pressure. The fluids of the first, second and third tanks were fed into a mixer, by constant delivery pumps, at a weight ratio of 242 grams from the first tank: 100 grams from the second tank: 1.80 grams from the third tank. The fluids were mixed under high agitation and dispensed into an open circular mold having a diameter of 31 inches and a thickness of 0.090 inches which had been preheated to 160° F. The open mold was placed in an oven at 160° F. for 15 minutes. After this time, the product was removed from the mold. Curing was continued for 18 hours at 230° F. The product was then allowed to cool to ambient temperature. A double-coated film tape with release liner was applied to one surface of the cured sheets. The film tape was commercially obtained from 3M as type 9609 double-coated film tape.

A circular pad having a 20" diameter was cut from the molded part. The pad was then cut to a thickness of 0.090 inches and the upper and lower surfaces of the pad were made parallel using a milling machine. Concentric circular grooves 0.020" wide×0.030" deep with a pitch of 0.060" were machined into the work surface. A window opening was then cut in the pad. The shape of the opening was rectangular, having dimensions of 0.5"×2.0", being positioned with the long axis radially oriented and centered 4" from the center of the pad. The pad opening was sealed on the liner side with a 4"×4" piece of 3M 9609 double-sided tape. A spacer, constructed of 0.010" polyester film, cut with dimensions to fit securely in the pad opening, was placed in the opening and firmly attached to the exposed adhesive of the 4"×4" 3M 9609 tape. A window resin was then prepared from the ingredients listed in Table 1.

TABLE 1

| Ingredients | Weight (grams) |
|---|---|
| Charge 1 | |
| LONZACURE MCDEA | 11.3 |
| VERSALINK P650 | 70.8 |
| ETHACURE 100 | 7.7 |

TABLE 1-continued

| Ingredients | Weight (grams) |
|---|---|
| Charge 2 | |
| AIRTHANE PHP-75D | 42.0 |
| DESMODUR N 3300A | 48.0 |

AIRTHANE PHP-75D prepolymer, obtained from Air Products and Chemicals, Inc, which describes it as the isocyanate functional reaction product of toluene diisocyanate and poly(tetramethylene glycol).
DESMODUR N 3300A aliphatic polyisocyanate, obtained from Bayer Corporation, Coatings and Colorants Division, which describes it as a polyfunctional aliphatic isocyanate resin based on hexamethylene diisocyanate.
NIAX Silicone L-1800 was obtained from GE Silicones.
LONZACURE MCDEA diamine curative, obtained from Air Products and Chemicals, Inc, which describes it as methylene bis(chlorodiethylanaline).
VERSALINK P250 oligomeric diamine curative was obtained from Air Products and Chemicals, Inc.
VERSALINK P650 oligomeric diamine curative, obtained from Air Products and Chemicals, Inc, which describes it as polytetramethylene ether glycol-diamine.
DABCO BL-19 catalyst, obtained from Air Products and Chemicals, Inc, which describes it as bis(2-dimethylamino ethyl)ether.
ETHACURE 100, obtained from Albemarle Corporation, which describes it as diethyltoluenediamine.

Charge 1 was added to an open stainless steel container and placed on a hot plate set at a temperature of 120° C. until the contents of the container became molten. The contents were thoroughly mixed with a stainless steel spatula until uniform. Charge 1 was then degassed to remove moisture and entrained air by placing the container in a vacuum oven set at 80° C. and pulling a vacuum of 1 mm to 5 mm Hg until bubbling ceased and any foaming subsided. The container was then removed from the vacuum oven, Charge 2 was added to Charge 1 and mixed with a spatula until uniform. The container was then placed in a second vacuum oven at ambient temperature and a 1 mm to 5 mm Hg vacuum was pulled for 5 minutes to remove any entrained air resulting from mixing.

The container of resin was then removed from the vacuum oven and a portion of the resin was carefully poured into the pad window opening, containing a spacer, so as not to introduce air voids into the resin. Sufficient resin was poured to bring the resin level flush with the upper pad surface. The resin was then allowed to cure overnight at ambient conditions. After curing, the 4"×4" piece of 3M 9609 double sided tape and the spacer were removed. The window area was then made coplanar with the pad work surface using a milling machine.

Example 2

A stacked pad was constructed by mounting the polishing pad assembly of Example 1 on a 22.0" diameter subpad. The subpad consisted of a polyurethane foam disk having a diameter of 20" which was die cut from a sheet of PORON FH 48 available from Rogers Corporation, Woodstock, Conn., having a thickness of 1.5 millimeters and a density of 0.48 g/cm$^3$. Another double-coated film tape with release liner was commercially obtained from Adhesives Research, Inc. under the trade name ARclad 90334. The adhesive side was applied to the surface of the polyurethane foam. A window opening was then cut into the 20" diameter foam pad and double-coated film tape with release liner. The shape of the opening was rectangular, having dimensions of 0.5"×2.0", being positioned with the long axis radially oriented and centered 4" from the center of the pad. Next, the release liner of the polishing pad assembly of Example 1 was removed, exposing the adhesive. The polishing pad assembly was then firmly bonded, with this adhesive, to the polyurethane foam side of the subpad. Care was taken during mounting so that the window opening in the subpad was aligned with the pad window. The remaining release liner on the subpad can be removed to permit attachment to a commercial planarizing apparatus.

The invention claimed is:

1. A method for producing a polishing pad comprising an at least partially transparent window, comprising:

a. forming a polyurethane urea-containing pad wherein said polyurethane urea comprises at least partially gas-filled cells, and wherein at least a portion of said at least partially gas-filled cells is formed in-situ;

b. producing an opening into said pad;

c. inserting a spacer into said opening;

d. filling said opening above said spacer with a resin material; and e. allowing said resin material to cure at a temperature of from 0° C. to less than 125° C.

2. The method of claim 1 further comprising:

f. removing said spacer.

3. The method of claim 1 wherein said pad is the reaction product of polyisocyanate, hydroxyl-containing material, amine-containing material and blowing agent.

4. The method of claim 1 wherein said pad is the reaction product of polyurethane prepolymer, amine-containing material and blowing agent.

5. The method of claim 1 wherein said pad is the reaction product of polyisocyanate and polyurethane prepolymer, optional hydroxyl-containing material, amine-containing material and blowing agent.

6. The method of claim 1 further comprising at least partially connecting to said pad a sub-pad; producing an opening in said sub-pad; and at least partially aligning said opening of said pad and said opening of said sub-pad.

7. The method of claim 1 further comprising at least partially connecting said pad to a second layer and at least partially connecting said second layer to a sub-pad; producing an opening in said second layer and said sub-pad; and at least partially aligning said opening in said polishing pad, said opening in said second layer and said opening in said sub-pad.

8. The method of claim 1 wherein said resin material is chosen from polyurethane prepolymers with curative, epoxy resins with curative, ultraviolet curable acrylics, and mixtures thereof.

9. The method of claim 1 wherein said window is at least partially transparent to wavelengths in the range of from 190 to 3500 nanometers.

10. The method of claim 1 wherein in step d, an amount of resin is used to fill said opening above said spacer such that said resin is flush with a polishing surface of said pad.

11. The method of claim 1 wherein in step e said temperature for cure is from 5° C. to 120° C.

12. The method of claim 1 wherein in step e said temperature for cure is from 10° C. to 115° C.

13. The method of claim 1 wherein in step e said temperature for cure is from 15° C. to 110° C.

14. The method of claim 1 wherein in step e said temperature for cure is from 22° C. to 105° C.

* * * * *